United States Patent [19]

Borkovitz et al.

[11] 3,938,033

[45] Feb. 10, 1976

[54] FERRORESONANT TRANSFORMER REGULATOR

[75] Inventors: Henry S. Borkovitz, Skokie; William E. Lucarz, Des Plaines, both of Ill.

[73] Assignee: Sola Basic Industries, Inc., Milwaukee, Wis.

[22] Filed: May 22, 1974

[21] Appl. No.: 472,182

[52] U.S. Cl. ..... 323/60; 317/50

[51] Int. Cl.[2] ..... G05F 3/06

[58] Field of Search ..... 317/50; 323/60, 61

[56] References Cited

UNITED STATES PATENTS

| | | | |
|---|---|---|---|
| 3,371,263 | 2/1968 | Walz et al. | 323/60 X |
| 3,450,894 | 6/1969 | Pollard | 317/50 X |
| 3,474,327 | 10/1969 | Logan | 323/61 X |

*Primary Examiner*—A. D. Pellinen

*Attorney, Agent, or Firm*—Smythe & Moore

[57] ABSTRACT

An electrical system wherein an electrical condition such as voltage is regulated by means of a static regulator of the ferroresonant type, including a high reactance transformer and wherein the regulator is particularly stable during start-up and under transient conditions by use of a clipping ballast load.

6 Claims, 3 Drawing Figures

FERRORESONANT TRANSFORMER REGULATOR

This invention relates to ferroresonant transformer electrical condition regulators.

The aforementioned type of ferroresonant regulator is well known in the art as shown by U.S. Pat. Nos. 2,143,745, 2,346,621, 2,535,169, 2,694,177 and 3,293,537, all issued to Joseph G. Sola. These regulators are well accepted and generally used because they combine the advantages of accurate regulation, lack of moving parts, compactness, reasonable cost and the requirement of minimum upkeep. While these regulators are generally satisfactory, they are affected by transients such as might occur at start-up. In some application where such instability would be troublesome, it would be very desirable to have a regulator which has all the advantages of the known ferroresonant transformer regulator but which is stable under transient and start-up conditions.

The principal object of the invention is to provide a static regulator whose output is relatively stable during transient conditions and at start-up.

In a specific embodiment of the invention, a high leakage reactance transformer, having a primary winding and at least one secondary winding means, has a magnetic shunt interposed between the primary and secondary winding means and a capacitor connected in shunt with at least one secondary winding to provide a ferroresonant circuit. To minimize the effect of transient conditions, such as may occur at start-up, an auxiliary load, which can be termed a "clipping ballast load," is connected to a secondary winding means to absorb the effects of a transient condition, particularly during start-up, and thereby to provide the load circuit with a more stable voltage condition.

These and other objects, advantages and features of the invention will become apparent from the following description and drawings which are merely exemplary.

Figure 1:
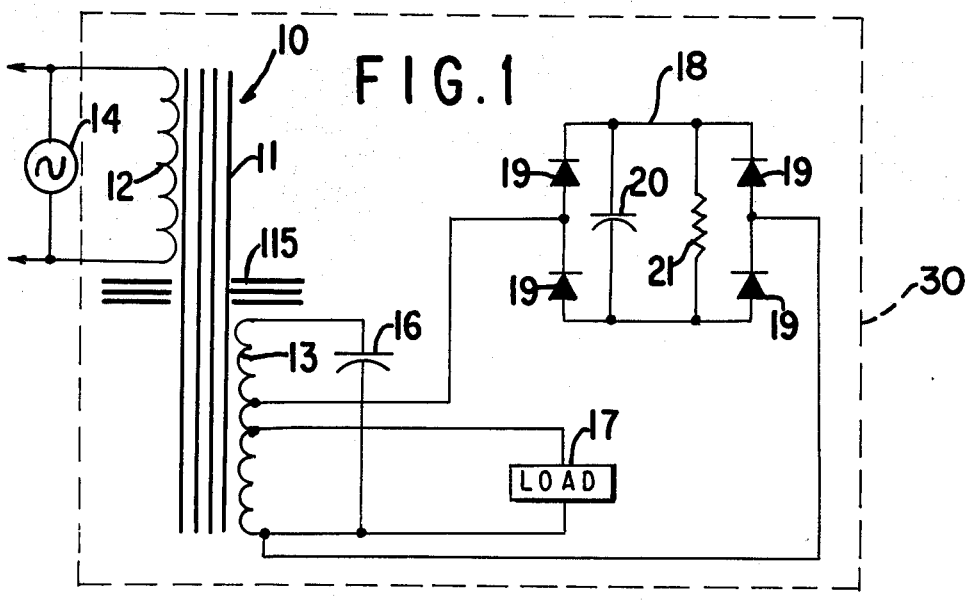
FIG. 1 shows one form of circuit which may be used.

Referring now to FIG. 1, a high leakage reactance transformer 10 is provided with a closed core 11 upon which are mounted primary winding 12 and secondary winding 13 with a magnetic shunt 115 interposed between the windings to provide a magnetic leakage path which diverts leakage flux away from the secondary winding. Primary winding 12 is energized from a conventional source of alternating current 14. Secondary winding 13 is shunted by capacitor 16 to provide a ferroresonant circuit and load 17 is connected across a predetermined portion of secondary winding 13, depending on the particular load voltage desired. As so far described, this regulator circuit arrangement is representative of the prior art ferroresonant high reactance transformer regulator arrangements disclosed in the previously mentioned patents to Sola.

Figure 3:
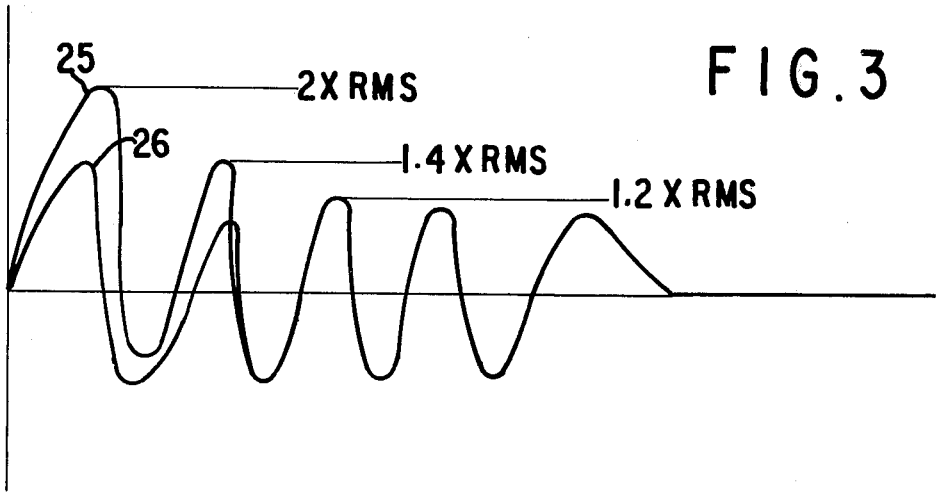
FIG. 3 shows the comparative wave forms of the voltage applied to the load during transient conditions at start-up for the prior art and for the present invention.

When such prior art ferroresonant high reactance transformer arrangement is subjected to a transient condition such as occurs at start-up, the load voltage behaves in accordance with the wave form 25 of FIG. 3. When the primary voltage is applied, a no-flux condition exists in core 11 and no charge exists in capacitor

16. Under these conditions, the voltage induced in secondary winding 13 rises sharply and may reach a RMS value twice that of steady conditions. Then as the applied voltage goes through successive cycles, conditions will stabilize and the voltage wave will stabilize at the designed RMS value and the regulator is operating properly. Where the load device is relatively insensitive to transient voltage excess, such performance would be considered acceptable. However, there are many load devices which are seriously affected by such transient voltage excesses, and with respect to such applications, the prior art devices would not be acceptable or as satisfactory as desired. The present invention results in an arrangement which substantially reduces the effect of such transient voltage excess. This is done by applying a high speed supplemental load to the secondary winding which serves to clip the voltage wave form during the transient condition to thereby produce a wave form more closely approximating the the steady state conditions.

This is done by connecting clipping ballast load 18 to the secondary winding 13, the particular point of connection being determined by the designed voltage value to be applied to ballast load 18. Ballast load 18 comprises a diode rectifier bridge consisting of diodes 19 whose direct current output is applied to capacitor 20 whose capacity is relatively high, the capacitor being shunted by a bleeder resistor 21. Since capacitor 20 is shunted by resistor 21, there would be no charge on capacitor 20 in a de-energized state and capacitor 20 would act as an instantaneous shunt when a voltage is first induced in secondary winding 13 and the current taken by capacitor 20 would decrease as the charge in capacitor 20 built up. As a result of the current taken by capacitor 20, the voltage at load 17 would rise to a lesser extent, and in actual practice, it was found that the initial voltage surge was limited to 1.4 times of the steady state RMS value. This is shown by wave form 26 in FIG. 3, wherein the initial surge rises to 1.4 times the steady state RMS value and then gradually reaches the steady state RMS value. Thus, because the capacitor is in discharge condition at start-up, it acts as more than a mere clipping function. Also, it helps to stabilize an oscillatory condition that might exist in the ferroresonant transformer.

It accordingly follows that the present arrangement results in an RMS stability not found in prior art ferroresonant high reactance transformer regulators and will provide acceptable performance with surge voltage sensitive load devices.

Figure 2:
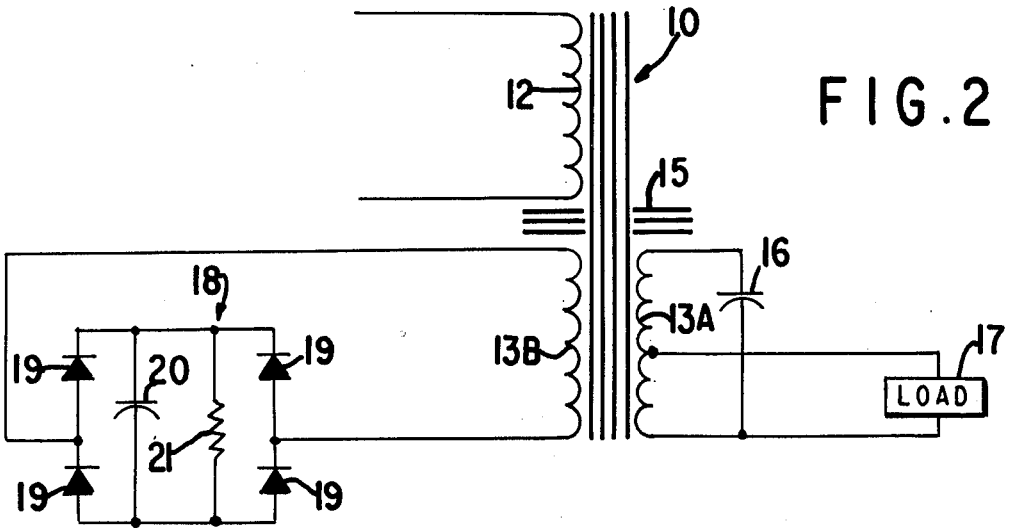
FIG. 2 shows a circuit modification illustrative of the invention.

Another satisfactory embodiment of the invention is shown in FIG. 2 wherein the high reactance transformer is provided with a secondary winding means composed of two secondary windings, secondary winding 13A which is shunted by capacitor 16 to provide ferroresonance and is connected to the load 17 and by clipping ballast load 18 connected to secondary winding 13B. Since secondary windings 13A and 13B are closely coupled, the operation of the arrangement of FIG. 2 would be the same as that of FIG. 1. However, in the case of FIG. 2, load 17 would be electrically isolated, and in some applications, this might be highly desirable.

The clipping ballast load 18 can be incorporated in the regulator housing 30 to provide a simple convenient overall structure.

It is apparant that variations can be made of circuitry without departing from the spirit of the invention except as defined by the appended claims.

What is claimed is:

1. In an alternating current regulator system resistant to the effects of transients such as occur at start-up, a source of alternating current energy, a high leakage reactance transformer, a primary winding therewith for connection to said source, secondary winding means having means for connection to a load, a magnetic shunt interposed between said primary winding and said secondary winding means, a first capacitor connected in shunt with said secondary winding means, means for minimizing the effects of transients such as occur during start-up comprising rectifier means connected to a portion of said secondary winding means, a second capacitor connected in shunt with the direct current output of said rectifier means and a resistor connected in shunt with said second capacitor, whereby the effects of voltage variation on said load due to transients is minimized.

2. An alternating current regulator system as defined in claim 1, wherein said secondary winding means comprises a plurality of secondary windings, the load being connected to only one of said secondary windings.

3. An alternating current regulator system as defined in claim 2, wherein said first capacitor is connected to said one of said plurality of secondary windings.

4. An alternating current regulator system as defined in claim 2, wherein said rectifier means is connected to the other of said plurality of secondary windings.

5. An alternating current regulator system as defined in claim 1, wherein said rectifier means comprises a diode bridge.

6. An alternating current regulator system as defined in claim 1, including housing means wherein the recited system including said means for minimizing the effects of transients is enclosed.

* * * * *